US006308684B1

(12) United States Patent
Konishi

(10) Patent No.: US 6,308,684 B1
(45) Date of Patent: Oct. 30, 2001

(54) FUEL INJECTION VALVE HAVING A PLURALITY OF INJECTION HOLES

(75) Inventor: Masaaki Konishi, Chiryu (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/504,927

(22) Filed: Feb. 16, 2000

(30) Foreign Application Priority Data

Feb. 16, 1999 (JP) ..... 11-036614

(51) Int. Cl.[7] ..... F02M 61/18
(52) U.S. Cl. ..... 123/432; 239/533.12
(58) Field of Search ..... 123/432; 239/533.12, 239/552, 558, 559

(56) References Cited

U.S. PATENT DOCUMENTS

Re. 33,841 * 3/1992 Rush et al. ..... 239/552
4,877,004 * 10/1989 Nishizawa ..... 123/432
4,890,794 * 1/1990 Imafuku et al. ..... 239/533.12
6,089,476 * 7/2000 Sugimoto et al. ..... 239/596

FOREIGN PATENT DOCUMENTS 3-63673 6/1991 (JP) .
3-63763 6/1991 (JP) .

* cited by examiner

*Primary Examiner*—Andrew M. Dolinar
(74) *Attorney, Agent, or Firm*—Nixon & Vanderhye PC

(57) ABSTRACT

In a fuel injection valve to be installed in a plurality of intake ports in each cylinder for engines, the fuel injection valve has a plate provided with a plurality of injection holes classified to first and second groups. The first group injection holes are so arranged on a circumference of a first circle so that fuel from the respective injection holes may be injected toward a first intake port and the second injection holes are so arranged on a circumference of a second circle so that fuel from the respective injection holes may be injected toward a second intake port. Diameters of the first and second circles are different so that the fuel flow amount distribution rate of the first group of injection holes to the second group of injection holes may be adjusted to a predetermined value on target.

2 Claims, 5 Drawing Sheets

FUEL INJECTION VALVE HAVING A PLURALITY OF INJECTION HOLES

CROSS REFERENCE TO RELATED APPLICATION

This application is based upon and claims the benefit of priority of Japanese Patent Application No. H.11-36614 filed on Feb. 16, 1999, the content of which is incorporated herein by reference.

BACKGROUND OF THE INVENTION

1. Field of the Invention

The present invention relates to a fuel injection valve provided with a plate having a plurality of injection holes at an injection port of a valve body thereof.

2. Description of Related Art

Recently, many high performance engines have been proposed that have a plurality of intake ports (a plurality of intake valves) in each of the cylinders. For example, as disclosed in JP-U-H.3-63763(refer to FIGS. 4 and 5), a fuel injection valve to be installed in an intake manifold of the engine is provided with a plate 13 having a plurality of injection holes 12*a* and 12*b* at an injection port of a valve body 11. Inclination angles (injection direction) of the respective holes 12*a* and 12*b* are so formed that fuel from the holes 12*a* and 12*b* may be injected toward the intake ports 14*a* and 14*b* on target, respectively. a group A of the injection holes 12*a* through which fuel is injected toward the intake port 14*a* and a group B of the injection holes 12*b* through which fuel is injected toward the intake port 14*b*. As the respective hole diameters of the injection holes 12*a* and 12*b* are same, a fuel flow amount distribution rate of the group A to the group B is considered adjustable by respective piece numbers of the injection holes 12*a* and 12*b* to be classified into the respective groups A and B.

In the fuel injection valve 10 mentioned above, the three group A injection holes 12*a* are arranged on a straight line. In the case of such a straight-line arrangement, the fuel flow amounts in the respective injection holes 12*a* are not identical, even if the hole diameters are the same. The reason is that, as highly pressurized fuel flows onto the plate 13 so as to swirl in a circular direction from an outer circumference gap of a needle valve (not shown), a flow speed of the fuel becomes variable along a radial direction on the plate 13.

Further, in a region of the plate 13 near the outer circumference thereof, the fuel flows downward obliquely from the outer circumference gap of the needle valve. An inflow angle of the fuel downward obliquely flowed to the plate 13 becomes smaller at a position nearer to the inside thereof. Therefore, respective flow amounts of the three injection holes 12*a* arranged on a straight line are different from each other, as the flow speeds and the inflow angles of the fuel to be flowed into the respective three injection holes 12*a* are different. As a result, it is very difficult to accurately adjust the fuel flow amount distribution rate of the group A injection holes to the group B injection holes only by the numbers of injection holes 12*a* and 12*b*.

Further, an injection valve is known, as shown in FIG. 6, in which a plate 15 is provided with same hole diameter injection holes 1 to 5 arranged on a circumference of a circle. The respective injection holes 1 to 5 are formed obliquely at an inclination angle (in an injection direction) so that the fuel from the respective injection holes 1 to 5 may be injected toward the respective intake ports on target. By arranging the injection holes 1 to 5 on the circumference of the circle, the respective flow speeds and the respective inflow angles of the fuel flowed into the respective injection holes 1 to 5 becomes identical. However, as shown in FIG. 7, the fuel flow amounts in the respective injection holes 1 to 5 are different from each other as the inclination angles of the respective injection holes 1 to 5 are different even if the hole diameters thereof are the same.

Next, with reference to FIG. 8, a reason why the respective different inclination angles of the injection holes 1 to 5 cause different fuel flow amounts is described. When the fuel, flowed onto the plate 15 from a gap between a needle valve and a valve body, flows in the respective injection holes 1 to 5, a contraction of the fuel flow takes place. As the contraction takes place based on an inertial force due to a fuel flow direction conversion, the contraction becomes larger in the injection holes 1 to 5 having the larger inclination angle. Therefore, as shown in FIG. 7, the fuel injection amount is smaller in the injection holes 1 to 5 having the larger inclination angle. As mentioned above, even if the same diameter injection holes 1 to 5 are arranged on the circumference of the circle, the fuel flow amounts in the respective injection holes 1 to 5 differ due to the difference of the respective inclination angles of the injection holes 1 to 5. As a result, the fuel flow amount distribution rate on target of one injection hole to another injection hole among the injection holes 1 to 5 or of the group A injection holes to the group B injection holes is hardly secured. FIG. 7 shows a relationship between an inclination angle of the injection hole and a flow amount rate, when the flow amount of the injection hole 5 having the inclination angle of 30° is referenced as 100.

Though the fuel flow amount distribution rate may be adjusted by changing the respective hole diameters of the infection holes 1 to 5, such a change causes a higher manufacturing cost for fabricating the injection holes 1 to 5.

SUMMARY OF THE INVENTION

The present invention has been made in view of the above mentioned problem, and an object of the present invention is to provide a fuel injection valve having a construction that the fuel flow amount distribution rate of one group to the other group may be easily adjusted with a less manufacturing cost.

To achieve the object mentioned above, the fuel injection valve has a plate provided with a plurality of injection holes classified to at least first and second groups. The first group injection holes are so arranged on a circumference of a first circle that fuel from the respective injection holes may be injected toward a first intake port and the second injection holes are so arranged on a circumference of a second circle that fuel from the respective injection holes may be injected toward a second intake port. Diameters of the first and second circles are different so that the fuel flow amount distribution rate of the first group injection holes to the second group injection holes may be adjusted to a predetermined value on target.

As the respective injection holes in the first or second group are arranged on the same circumference of a circle, flow speed and inflow angle of fuel flowed into the respective injection holes in the first or second group are same.

However, as inclination angles of the respective injection holes in the first or second group are not same, the respective fuel flow amounts of the injection holes in the first or second group are not same because of different largeness of the contraction decisive by the inflow angle of fuel and the inclination angle of the injection hole.

Under the circumstances mentioned above, for example, if the diameter of the first circle becomes larger, the respective fuel flow amounts of the injection holes becomes larger at the same rate with each other so that the fuel flow amount distribution rate of the first group to the second group may be easily adjusted. This is because more outwardly shifted positions of the injection holes cause the larger inflow angle of fuel, which results in the smaller contraction, and the more increased flow speed of fuel.

An another aspect of the present invention, instead of changing the diameter of the first or second circle for adjusting the fuel flow amount distribution rate, the respective injection holes in the first and second groups are so arranged respectively at positions radially independently away from a center axis of the valve body that the fuel flow amounts of the respective injection holes are identical to each other. In this case, the fuel flow amount distribution rate of the first group to the second group may be decided by the piece numbers of the injection holes of the first group to those of the second group.

As a further aspect of the invention, the hole diameters of the injection holes at least in the first group may be same with each other. Further, the injection hole having a larger inclination angle in the first group is located at a position more radially far away from the center axis of the valve body. As a result, the fuel flow amount distribution rate between the first and second groups may be easily adjusted.

It is preferable in the fuel injection valve mentioned above that the hole diameters of the injection holes of the first and second groups are all same for more easily adjusting the fuel flow amount rate of one injection hole to the other injection hole among the injection holes or of the first group injection holes to the second group injection holes as well as for easily fabricating the injection holes on the plate.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Figure 1:
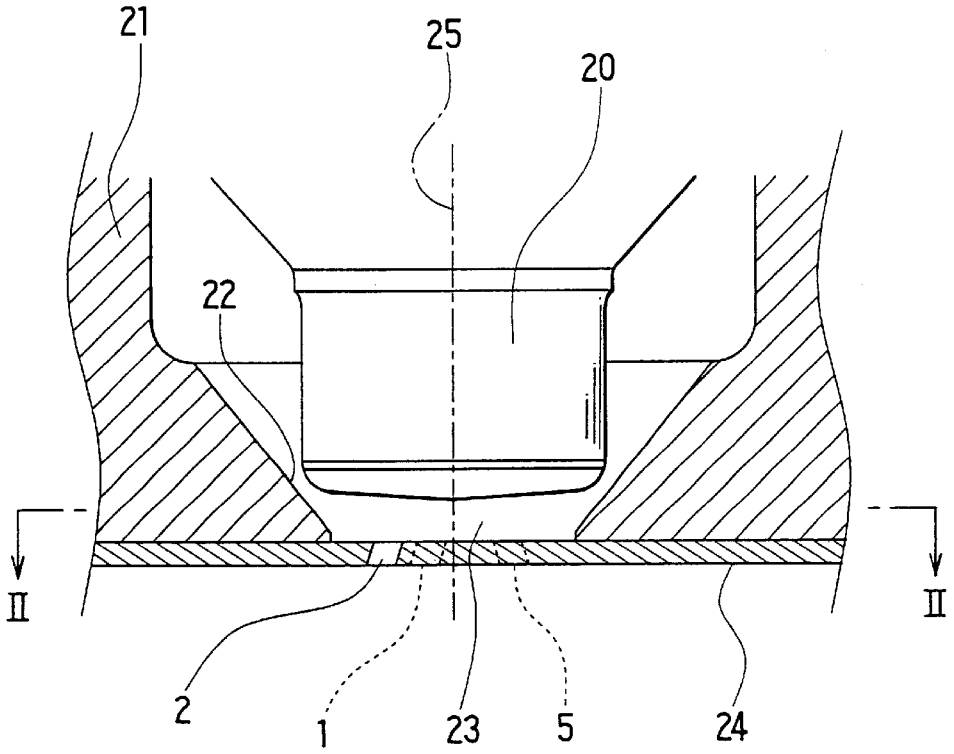
FIG. 1 is a cross sectional partial view of the fuel injection valve according to an embodiment of the present invention.

A fuel injection valve according to a preferred embodiment of the present invention is described hereinafter with reference to FIGS. 1 to 3. The fuel injection valve is installed on an engine intake manifold (not shown) having, for example, two intake ports (two intake valves). The injection valve is composed of, as shown in FIG. 1, a valve body 21, a needle valve 20 housed in the valve body 21, an electromagnetic device (not shown) and a plate 24. A taper shaped valve seat 22 is provided at a lower portion of the valve body so that an opening of the valve seat 22 may constitute an injection port 23. The injection port 23 is opened and closed by an up and down movement of the needle valve 20 due to the operation of the electromagnetic device.

Figure 2:
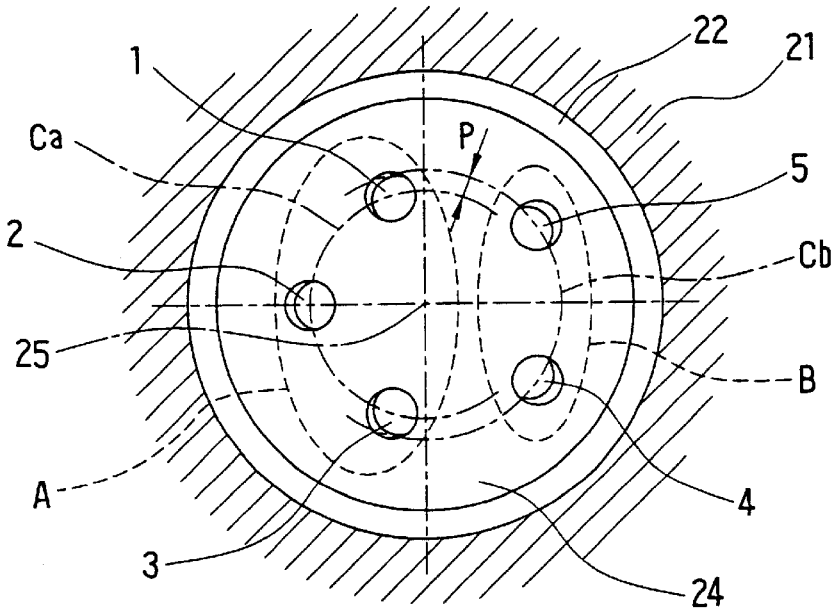
FIG. 2 is a cross sectional view taken along a line II—II of FIG. 1.

As shown in FIG. 2, the plate 24 is provided with, for example, 5 pieces of injection holes 1 to 5 whose hole diameters are all same. Inclination angles (injection direction) of the respective injection holes 1 to 5 are so formed that fuel from the respective injection holes 1 to 5 may be injected toward the respective intake ports on target.

Among the five injection holes 1 to 5, three injection holes 1 to 3 on a left side, which inject fuel to one of the intake ports, are classified to a group A and two injection holes 4 and 5 on a right side, which inject fuel to the other of the intake ports, are classified to a group B. The respective injection holes 1 to 3 in the group A and the respective injection holes 4 and 5 in the group B are formed on respective different diameter circles Ca and Cb. The circles Ca and Cb are concentric and both the centers of the circles Ca and Cb are on a center axis 25 of the valve body 21.

Half-diameters of the circles Ca and Cb of the groups A and B are different by a certain value P(pitch difference P) for the purpose of adjusting the fuel flow amount distribution rate of the groups A to the group B to achieve a target value of 60% to 40% therebetween.

Figure 6:
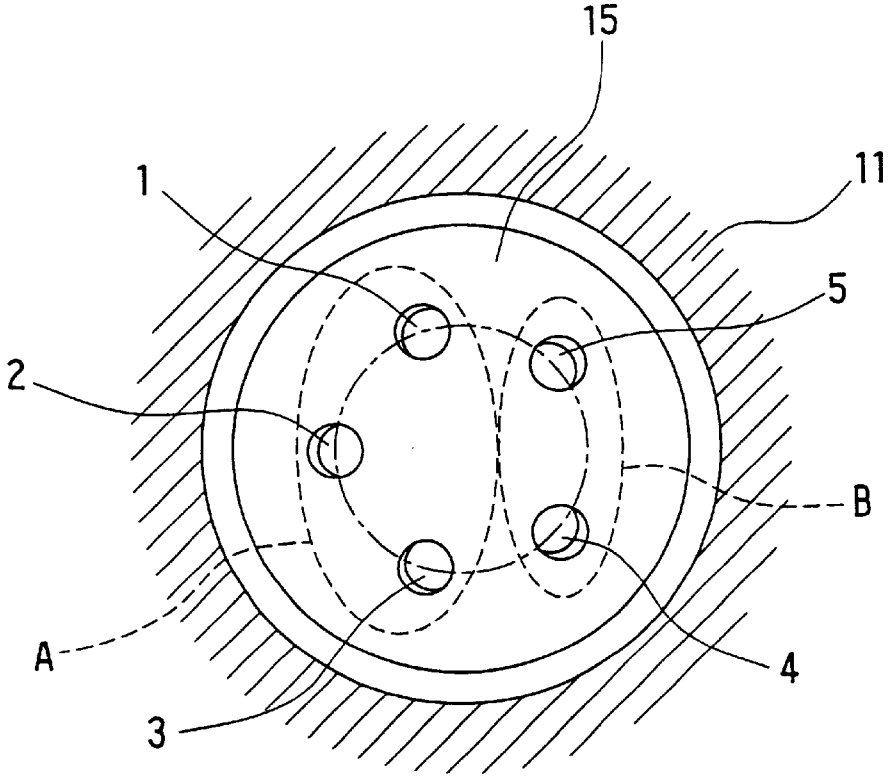
FIG. 6 PRIOR ART
FIG. 6 is a plan view of an improved conventional plate.
Figure 7:
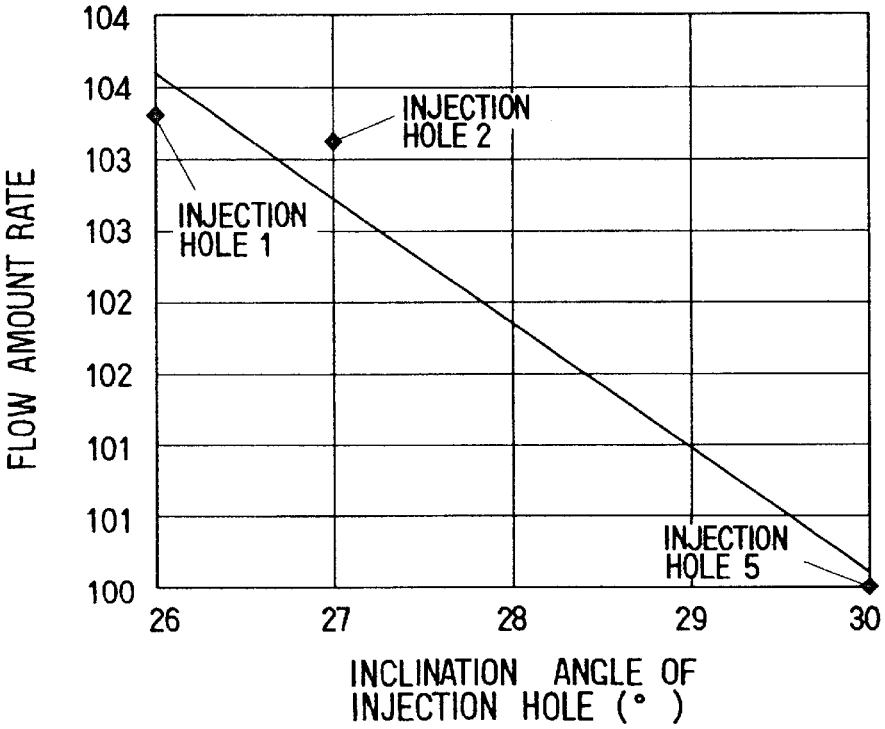
FIG. 7 is a graph showing a relationship between inclination angle of the injection hole and fuel flow rate.
Figure 8:
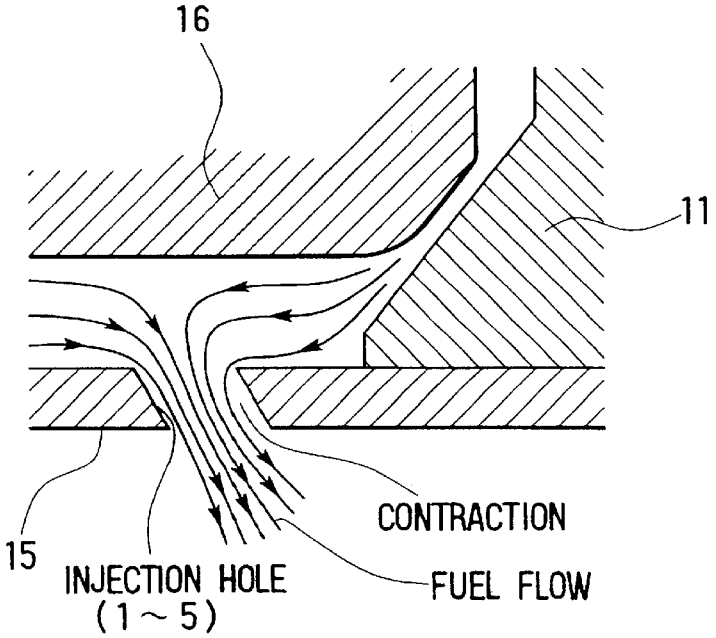
FIG. 8 is an enlarged cross sectional view explaining fuel flowing into the injection hole of the plate.

According to a conventional fuel injection valve, as the injection holes 1 to 5 are arranged on a circumference of one circle, as shown in FIG. 6, the fuel flow amount distribution rate on target can not be secured due to a difference of the inclination angles of the injection holes 1 to 5. This is because larger is the inclination angle, the contraction is larger so that the injection flow amount may be smaller, as shown in FIG. 7.

Therefore, according to the embodiment of the present invention, considering the relationship between the inclination angle and position of each of the injection holes 1 to 5 and the fuel flow amount distribution rate among the injection holes 1 to 5, the fuel flow amount distribution rate of the groups A to the group B is adjusted to attain the value on target.

In a region of the plate 24 near the outer circumference thereof, the fuel flows downward obliquely from the outer circumference gap of the needle valve 20. An inflow angle of the fuel downward obliquely flown to the plate 24 becomes smaller at a position nearer to the inside thereof. Thus, the position of the injection hole is positioned more inside, the fuel flows more horizontally from a lower position into the injection holes so that the contraction may becomes larger, resulting in the smaller fuel flow amount.

Vise versa, the position of the injection hole is positioned more outside, the fuel flows more obliquely from an upper position into the injection holes so that the contraction may becomes smaller, resulting in the larger fuel flow amount. For adjusting the fuel flow amount distribution rate of one of the injection holes 1 to 5 to the other thereof, shifting outside the injection hole results in increasing the fuel flow amount distribution thereof and shifting inside the injection hole results in decreasing the fuel flow amount distribution thereof.

When the injection holes 1 to 5 whose hole diameters are same are formed on a same circumference of one circle, as shown in FIG. 6, the fuel flow amount distribution rate of the group A (injection holes 1 to 3) to the group B is 61%, which is higher than a target value, 60%. This is because that an average inclination angle of the injection holes 1 to 3 in the group A is smaller that that of the injection holes 4 and 5 in the group B.

Therefore, according to the fuel injection valve of the present invention, the positions of the injection holes are so adjusted in a manner that the injection holes 4 and 5 in the group B having a larger average inclination angle are located at an outside position and the injection holes 1 to 3 in the group B having a smaller inclination angle at an inside position. As a result, the fuel flow amount distribution rate of the groups A to the group B achieves the target value, 60 to 40.

Figure 3:
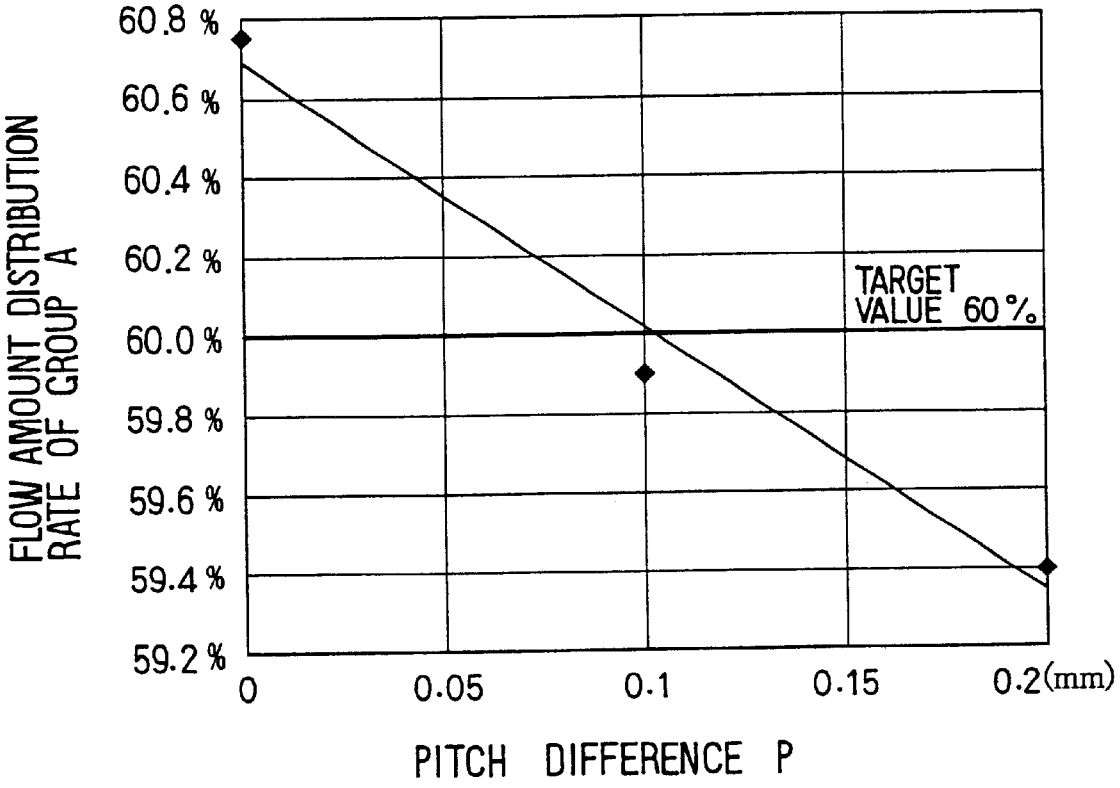
FIG. 3 is a graph showing a relationship between a pitch difference P between groups A and B and fuel flow amount distribution rate of the group A to the group B.
Figure 4:
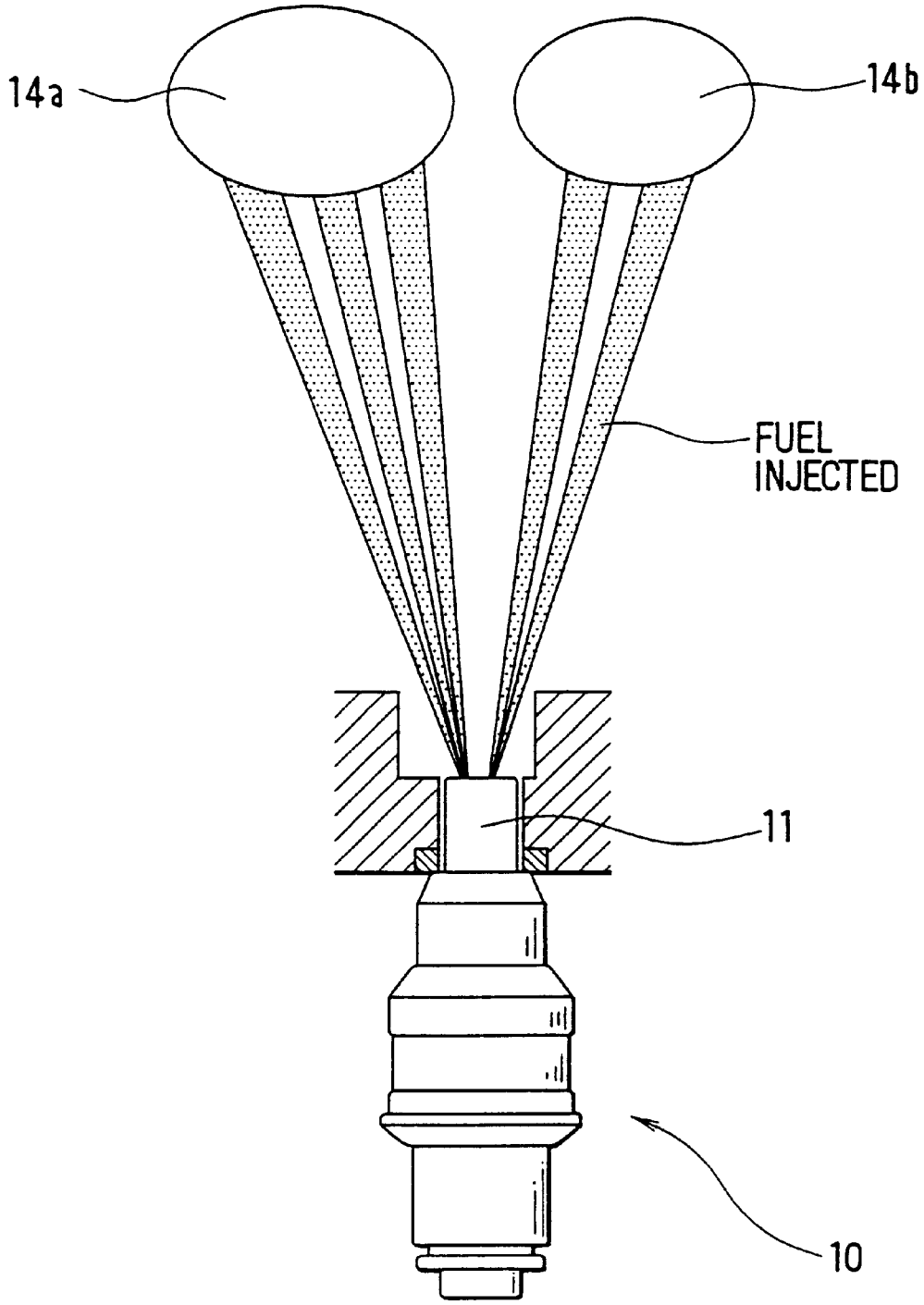
FIG. 4 PRIOR ART
FIG. 4 is a schematic view showing atomized fuel injection of a conventional fuel injection valve.
Figure 5:
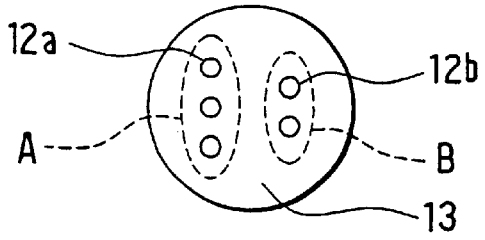
FIG. 5 PRIOR ART
FIG. 5 is a plan view of a conventional plate with injection holes.

As a test and measurement result, FIG. 3 shows a relationship between a pitch difference P between the groups A and B (the half-diameter difference between the circles Ca and Cb) and the fuel flow amount distribution rate of the group A to the group B. As clearly understood from the measurement result, larger the pitch difference P is, the fuel flow amount distribution rate of the group A to the group B is more decreased. And, when the pitch difference P is 0.1 mm, the fuel flow amount distribution rate of the group A becomes nearly the target value (60%).

As mentioned above, in the fuel injection valve having a plurality of the injection holes, the fuel flow amounts of the respective injection holes may be adjustable by shifting radially the positions of the injection holes from the center axis of the valve body, respectively. Therefore, instead of changing the diameters on which the groups A and B are arranged, respectively, the respective distances from the center axis of the valve body to the positions where the respective injection holes are arranged may be changed so that the respective fuel flow amounts of all the injection holes become same with each other.

That is, as more outwardly shifted positions of the injection holes cause larger inflow angle of fuel, which results in the smaller contraction, and the more increased flow speed of fuel from the gap between the valve body and the needle valve, the fuel flow amount of each of the injection holes may be adjusted by shifting the position of the injection hole radially outwardly, when increasing the fuel flow amount, and radially inwardly, when decreasing the fuel flow amount. In this case, the fuel flow amount distribution rate of the group A to the group B may be decided by the piece numbers of the injection holes of the group A to those of the group B.

In case of the injection holes having the same hole diameters and arranged on the same circumference of one circle, larger the inclination angle of the injection hole is, the contraction is larger so that the injection amount from the injection hole becomes smaller. When any two of the injection holes are arranged to have the same fuel flow amounts, the injection hole having a smaller inclination angle is positioned more radially inside, compared with the injection hole having a larger inclination angle.

Though it is preferable that all the injection holes have same hole diameters for easy fabrication of the fuel injection valves, the injection holes may include one or more injection holes having different hole diameters. This is because the fuel flow amount distribution rate of the group A to the group B may be adjusted, as mentioned above, by shifting the positions of any one or more of the injection holes in the group A and/or B radially away from the center axis of the valve body or by differing the diameters of the respective circles, on the circumferences of which the injection holes in the groups A and B are respectively arranged.

The numbers of the injection holes are not limited to 5 pieces, as far as they are plural, and the numbers of the intake ports (intake valves) in one cylinder are not limited to two, but may be more.

What is claimed is:

1. A fuel injection valve to be installed on an intake manifold having at least first and second intake ports in each cylinder of an internal combustion engine comprising:

a valve body member having an injection bore through which fuel is injected; and a plate disposed at the injection bore, the plate having a plurality of injection holes defining first and second groups of injection holes, the injection holes being formed at respective inclination angles to a line perpendicular to the plate and the first and second groups of injection holes being arranged respectively on first and second concentric circles of different circumferences centered on a center axis of the valve body member so that fuel from the first group of injection holes on the first circle is injected toward the first intake port and fuel from the second group of injection holes on the second circle is injected toward the second intake port, wherein a fuel flow amount distribution rate of the first group of injection holes to the second group of injection holes is substantially equal to a number ratio of the first group of injection holes to the second group of injection holes, and wherein hole diameters of the plurality of injection holes are substantially the same, a radius of the first circle is greater than a radius of the second circle, a difference between said radius of said first circle and said radius of said second circle is less than said hole diameter, and an average inclination angle of the injection holes of the first group of injection holes is larger than an average inclination angle of the injection holes of the second group of injection holes.

2. A fuel injection valve to be installed on an intake manifold having at least first and second intake ports in each cylinder of an internal combustion engine comprising:

a valve body member having an injection bore through which fuel is injected; and a plate disposed at the injection bore, the plate having a plurality of injection holes defining first and second groups of injection holes, the injection holes being formed at respective inclination angles to a line perpendicular to the plate and being arranged respectively at positions radially independently spaced from a center axis of the valve body member so that fuel from the first group of injection holes is injected toward the first intake port and fuel from the second group of injection holes is injected toward the second intake port, wherein the fuel flow amounts of the respective injection holes are identical to each other and a fuel flow amount distribution rate of the first group of injection holes to the second group of injection holes is substantially equal to a number ratio of the first group of the injection holes to the second group of injection holes, and wherein hole diameters of the plurality of injection holes are substantially the same, one of said first and second groups of injection holes having injection holes that have a smaller inclination angle than the holes of the other of said first and second groups of injection holes, said injection holes of said one group being respectively positioned radially inside so as to be nearer to the center axis of the valve body member than the injection holes of said other group, and a difference in the distance from the center axis of the valve body member of the injection holes of said first and second groups is smaller than said hole diameter thereof.

* * * * *